US005905008A

United States Patent [19]

Yoshinaga et al.

[11] Patent Number: 5,905,008

[45] Date of Patent: May 18, 1999

[54] ELECTROPHOTOGRAPHIC PHOTOSENSITIVE MEMBER, AND ELECTROPHOTOGRAPHIC APPARATUS AND PROCESS CARTRIDGE EMPLOYING THE SAME

[75] Inventors: Kazuo Yoshinaga, Kawasaki; Shunichiro Nishida, Yokohama; Keiko Hiraoka, Shizuoka-ken; Yayoi Nagao, Mishima; Hideki Kobayashi, Ichihara; Toru Masatomi, Ichihara, all of Japan

[73] Assignee: Canon Kabushiki Kaisha, Tokyo, Japan

[21] Appl. No.: 08/867,523

[22] Filed: Jun. 2, 1997

[30] Foreign Application Priority Data

Jun. 5, 1996 [JP] Japan ..... 8-142835

[51] Int. Cl.[6] ..... G03G 5/047; G03G 5/147; G03G 15/00

[52] U.S. Cl. ..... 430/58; 430/66; 430/67; 430/96; 399/159

[58] Field of Search ..... 430/58, 66, 67, 430/96

[56] References Cited

U.S. PATENT DOCUMENTS

| | | | |
|---|---|---|---|
| 3,859,090 | 1/1975 | Yoerger et al. | 430/66 |
| 5,242,774 | 9/1993 | Odell et al. | 430/58 |
| 5,266,431 | 11/1993 | Mammino et al. | 430/96 |
| 5,320,923 | 6/1994 | Nguyen | 430/78 |
| 5,436,099 | 7/1995 | Schank et al. | 430/96 |
| 5,626,998 | 5/1997 | Grabowski et al. | 430/67 |
| 5,652,078 | 7/1997 | Jalbert et al. | 430/67 |
| 5,667,926 | 9/1997 | Maruyama et al. | 430/66 |

FOREIGN PATENT DOCUMENTS

| | | |
|---|---|---|
| 0524506 | 1/1993 | European Pat. Off. . |
| 57-30843 | 2/1982 | Japan . |
| 61-132954 | 6/1986 | Japan . |
| 4-324454 | 11/1992 | Japan . |

OTHER PUBLICATIONS

Patent Abstracts of Japan, vol. 1, No. 320 (P–1558), Jun. 1993 of JP 05–034940A.

Noll, Chemistry and Technology of Silicones, Chapter 5, pp. 190–245, published by Academic Press 1968.

*Primary Examiner*—Roland Martin

*Attorney, Agent, or Firm*—Fitzpatrick, Cella, Harper & Scinto

[57] ABSTRACT

An electrophotographic photosensitive member has a photosensitive layer formed on a support. A surface layer (or the outermost layer) of the photosensitive layer contains a fluorine-modified organic silicone resin represented by the following average unit formula:

$$\{F(CF_2)_{a1}\text{-}Q_1\text{-}R_{1.m1}SiO_{(3\text{-}m1)/2}\}_{X1}\{F(CF_2)_{a2}\text{-}Q_2\text{-}R_{2.m2}SiO_{(3\text{-}m2)/2}\}_{X2}\cdots\{F(CF_2)_{ap}\text{-}Q_p\text{-}R_{p.mp}SiO_{(3\text{-}mp)/2}\}_{Xp}\{R_1{}'_{n1}SiO_{(4\text{-}n1)/2)}\}_{y1}\{R_2{}'_{n2}SiO_{4\text{-}n2)/2}\}_{y2}\cdots\{R_q{}'_{nq}SiO_{(4\text{-}nq)/2}\}_{yq}$$

where $R_1$–$R_p$ and $R_1'$–$R_q'$ are each an alkyl or aryl group; $Q_1$–$Q_p$ are each an alkylene group; m1–mp are each an integer of 0 to 2; n1–nq are each an integer of 0 to 3; a1–aq are each an integer; x1–y1 are each a number larger than 0; and X2–Xp and Y2 are each respectively a number of 0 or more.

9 Claims, 4 Drawing Sheets

ELECTROPHOTOGRAPHIC PHOTOSENSITIVE MEMBER, AND ELECTROPHOTOGRAPHIC APPARATUS AND PROCESS CARTRIDGE EMPLOYING THE SAME

BACKGROUND OF THE INVENTION

1. Field of the Invention

The present invention relates to an electrophotographic photosensitive member widely used for copying machines, printers, engraving systems, and the like apparatuses. The present invention also relates to an electrophotographic apparatus and a process cartridge employing the above electrophotographic photosensitive member.

2. Related Background Art

Conventionally, an electrophotographic photosensitive member is subjected directly to electric or mechanical action in the processes of electric charging such as corona charging and roller charging, development, image transfer, cleaning, and so forth, and is required to be resistant to the above actions.

Specifically, the electrophotographic photosensitive member should be resistant to abrasion and scratching by friction on the surface, and to electrical deterioration. In particular, in a charging system like a roller charging system utilizing electric discharge, the photosensitive member should be durable against high energy arc discharge.

Further, the surface of the electrophotographic photosensitive member should have higher cleanability in repeated toner development and toner cleaning without causing toner sticking to the surface.

To satisfy the above requirements for the photosensitive member surface, a surface protection layer mainly composed of a resin is provided. For example, Japanese Patent Application Laid-Open No. 57-30843 suggests a protection layer in which resistance is controlled by adding a particulate metal oxide as electroconductive particles.

Besides the protection layer, the incorporation of additives into the charge-transporting layer is studied to improve the properties of the photosensitive member surface. For example, silicone resins having a low surface energy are disclosed as below:

silicone oil (Japanese Patent Application Laid-Open No. 61-132954), polydimethylsiloxane, silicone resin powder (Japanese Patent Application Laid-Open No. 4-324454), crosslinked silicone resin, poly(carbonate-silicone) block copolymer, silicone-modified polyurethane, and silicone-modified polyester.

The typical polymers of a low surface energy includes fluoropolymers. The fluoropolymers below are useful as additives for the photosensitive layer: powdery polytetrafluoroethylene, and powdery fluorocarbons.

However, a surface protecting layer containing a metal oxide or the like, which has a higher hardness, tends to have a higher surface energy to result in lower cleanability and other shortcomings. A silicone type resin, which is advantageous as additives in lowering the surface energy, is less compatible with other polymers, so that it is liable to agglomerate in the photosensitive member to cause light scattering, or to bleed out of the surface to render unstable the properties of the photosensitive member. A fluoropolymer typified by polytetrafluoroethylene (PTFE) has a low surface energy, but is insoluble in solvents and less dispersible, producing a less smooth surface of the photosensitive member. Further, the fluoropolymer has a low refractive index, causing generally light scattering and deterioration of the latent image thereby.

High polymers like polycarbonate, polyacrylate esters, polyesters, and polytetrafluoroethylene are generally less resistant to arc discharge, and readily deteriorate by fission of the polymer main chain by electric discharge.

SUMMARY OF THE INVENTION

An object of the present invention is to provide an electrophotographic photosensitive member which has low surface energy and excellent mechanical and electrical durability, and produces image of high resolution without light scattering and surface-bleeding.

Another object of the present invention is to provide an electrophotographic apparatus and a process cartridge employing the electrophotographic photosensitive member.

The electrophotographic photosensitive member has a photosensitive layer formed on a support, a surface layer of photosensitive member containing a fluorine-modified organic silicone resin represented by an average unit formula (I) below:

$$\{F(CF_2)_{a1}\text{-}Q_1\text{-}R_{1.m1}SiO_{(3\text{-}m1)/2}\}_{X1}\{F(CF_2)_{a2}\text{-}Q_2\text{-}R_{2.m2}SiO_{((3\text{-}m2)/2}\}_{X2}\cdots\{F(CF_2)_{ap}\text{-}Q_p\text{-}R_{p.mp}SiO_{(3\text{-}mp)/2}\}_{Xp}\{R_1{}'_{n1}SiO_{(4\text{-}n1)/2)}\}_{y1}\{R_2{}'_{n2}SiO_{4\text{-}n2)/2}\}_{y2}\cdots\{R_q{}'_{nq}SiO_{(4\text{-}nq)/2}\}_{yq} \quad (I)$$

where $R_1$–$R_p$ and $R_1'$–$R_q'$ are each an alkyl or aryl group; $Q_1$–$Q_p$ are each an alkylene group; m1–mp are each an integer of 0 to 2; n1–nq are each an integer of 0 to 3; a1–aq are each an integer; x1–y1 are each a number larger than 0; and X2–Xp and Y2 are each respectfully a number of 0 or more.

DESCRIPTION OF THE PREFERRED EMBODIMENTS

Figure 1:
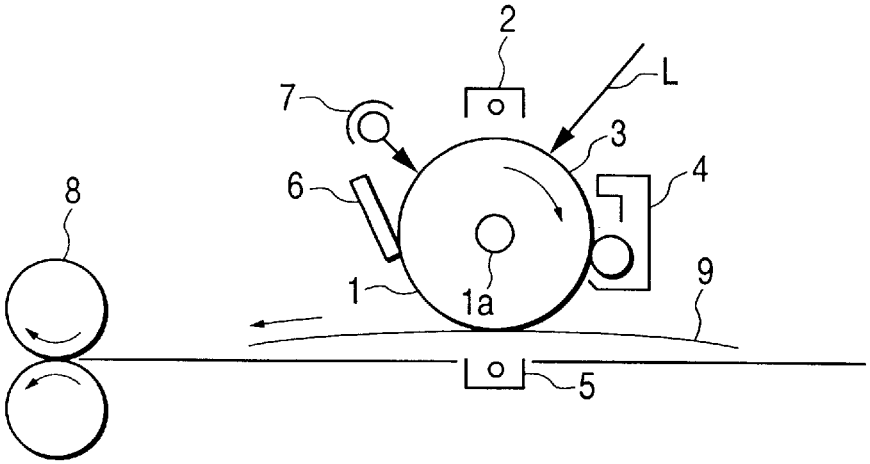
FIG. 1 is a schematic front view of an example of the electrophotographic apparatus of the present invention.

The electrophotographic photosensitive member of the present invention has a photosensitive layer formed on a support, the photosensitive layer having a surface layer containing a fluorine-modified organic silicone resin represented by an average unit formula (I) below:

$$\{F(CF_2)_{a1}\text{-}Q_1\text{-}R_{1.m1}SiO_{(3\text{-}m1)/2}\}_{X1}\{F(CF_2)_{a2}\text{-}Q_2\text{-}R_{2.m2}SiO_{(3\text{-}m2)/2}\}_{X2}\cdots\{F(CF_2)_{ap}\text{-}Q_p\text{-}R_{p.mp}SiO_{(3\text{-}mp)/2}\}_{Xp}\{R_1{}'_{n1}SiO_{(4\text{-}n1)/2)}\}_{y1}\{R_2{}'_{n2}SiO_{4\text{-}n2)/2}\}_{y2}\cdots R_q{}'_{nq}SiO_{(4\text{-}nq)/2}\}_{yq} \quad (I)$$

where $R_1$–$R_p$ and $R_1'$–$R_q'$ are each an alkyl or aryl group; $Q_1$–$Q_p$ are each an alkylene group; m1–mp are each an integer of 0 to 2; n1–nq are each an integer of 0 to 3; a1–aq are each an integer; x1–y1 are each a number larger than 0; and X2–Xp and Y2 are each respectively a number of 0 or more.

The surface layer in the present invention means a protective layer when it is provided, or a photosensitive layer when no protective layer is provided. In the case where the photosensitive layer is constituted of plural layers and no protection layer is provided, the surface layer means the farthest layer from the support.

In the above formula (I), the symbols $R_1$–$R_p$ and $R_1'$–$R_q'$ are each preferably an alkyl or aryl group of 1 to 12 carbons. The alkyl group may be linear, branched, or cyclic, including, for example, methyl, ethyl, propyl, isopropyl, butyl, pentyl, hexyl, cyclohexyl, heptyl, octyl, nonyl, decyl, undecyl, and dodecyl. An alkyl group of a larger carbon number is not preferred since it lowers the mechanical strength of the surface layer when it is incorporated in the surface layer. The preferred aryl group includes phenyl, tolyl, xylyl, naphthyl, and biphenyl. An aryl group of a larger carbon number is not preferred since it lowers the arc discharge resistance of the surface layer when it is incorporated in the surface layer.

The symbols $Q_1$–$Q_p$ are each respectively an alkylene group preferably of 2 to 6 carbons, including an ethylene group and a propylene group. The symbols m1–mp are each respectively an integer of 0 to 2. The symbols n1–nq are each respectively an integer of 0 to 3. The symbols a1–aq are each respectively an integer. The symbols; x1 and y1 are respectively a number larger than 0; and x2–xp and y2–yq are each respectively a number of 0 or more, the ratio of (x1+x2+. . .+xp):(y1+y2+. . .+yq) ranging preferably from 1:20 to 1:5.

The fluorine-modified organic silicone resin of the present invention has a softening point of preferably not lower than 30° C. To obtain the softening point of 30° C. or higher, the groups of $R_1$–$R_p$ and $R_1'$–$R_q'$ are each preferably an aryl group such as phenyl. The resin may contain some residual silanol or alcohol groups. The ratio of the aryl groups in the groups of $R_1$–$R_p$ and $R_1'$–$R_q'$ is preferably not less than 20 mol%. The fluorine-modified organic silicone resin has a weight-average molecular weight ranging from 1000 to 100000. The resin of a lower weight-average molecular weight can decrease the mechanical strength of the surface layer, whereas the resin of a higher weight-average molecular weight can be less compatible with the binder resin to cause white turbidity and lower charge transportation ability. The weight-average molecular weight in the present invention is derived by GPC (gel permeation chromatography).

The fluorine-modified organic silicone resin in the present invention is exemplified by the ones represented by the following average unit formulas:

$\{F(CF_2)_4C_2H_4SiO_{3/2}\}_{0.1}\{(CH_3)_2SiO_{1/2}\}_{0.9}(SiO_{4/2})_{1.0}$, $\{F(CF_2)_4C_2H_4(CH_3)SiO_{2/2}\}_{0.1}\{(CH_3)_3SiO_{1/2}\}_{0.9}(SiO_{4/2})_{1.0}$, $\{F(CF_2)_8C_2H_4(CH_3)SiO_{2/2}\}_1\{(C_6H_5)_2SiO_{2/2}\}_{10}$, $\{F(CF_2)_8C_2H_4SiO_{3/2}\}_1\{(CH_3)_2SiO_{2/2}\}_{18}\{(C_6H_5)SiO_{3/2}\}_2$, $\{F(CF_2)_4C_2H_4SiO_{3/2}\}_1\{(CH_3)SiO_{3/2}\}_9$, $\{F(CF_2)_4C_2H_4SiO_{3/2}\}_1\{(C_6H_5)SiO_{3/2}\}_9$, $\{F(CF_2)_4C_2H_4SiO_{3/2}\}_1\{(CH_3)_3SiO_{1/2}\}_{1.2}\{SiO_{4/2}\}_{0.1}\{(C_6H_5)SiO_{3/2}\}_9$, $\{F(CF_2)_4C_2H_4SiO_{3/2}\}_1\{(C_6H_5)_2SiO_{2/2}\}_9$, $\{F(CF_2)_8C_2H_4(CH_3)SiO_{2/2}\}_1\{(C_6H_5)_2SiO_{2/2}\}_8\{(C_6H_5)SiO_{3/2}\}_1$, $\{F(CF_2)_8C_2H_4SiO_{3/2}\}_1\{(CH_3)_3SiO_{1/2}\}_{0.7}\{SiO_{4/2}\}_{1.0}(C_6H_5)_2SiO_{2/2}\}_{10}$, $\{F(CF_2)_8C_2H_4(CH_3)SiO_{2/2}\}_1\{(CH_3)_3SiO_{1/2}\}_{0.7}\{SiO_{4/2}\}_{1.0}\{(C_6H_5)_2SiO_{2/2}\}_8$, $\{F(CF_2)_8C_2H_4SiO_{3/2}\}_1\{(C_6H_5)SiO_{3/2}\}_9$, $\{F(CF_2)_8C_2H_4SiO_{3/2}\}_1\{(C_6H_5)_2SiO_{2/2}\}_9$, $\{F(CF_2)_8C_2H_4SiO_{3/2}\}_1\{(C_6H_5)_2SiO_{2/2}\}_5\{(C_6H_5)SiO_{3/2}\}_5$, $\{F(CF_2)_4C_2H_4SiO_{3/2}\}_1\{(CH_3)_2SiO_{2/2}\}_1\{(C_6H_5)SiO_{3/2}\}_6$, $\{(CF_3)C_2H_4SiO_{3/2}\}\{(F(CF_2)_8C_2H_4SiO_{3/2}\}_1\{(CH_3)_3SiO_{1/2}\}_3\{(C_6H_5)_2SiO_{2/2}\}_{13}$, $\{F(CF_2)_8C_2H_4SiO_{3/2}\}_1\{(CH_3)_3SiO_{1/2}\}_5\{(C_6H_5)_2SiO_{2/2}\}_5\{SiO_{4/2}\}_6$, $\{(CF_3)C_2H_4SiO_{3/2}\}_3\{(CH_3)_3SiO_{1/2}\}_4\{(C_6H_5)SiO_{3/2}\}_4\{SiO_{4/2}\}_{10}$, $\{(CF_3)C_2H_4SiO_{3/2}\}_3\{F(CF_2)_4C_2H_4SiO_{3/2}\}_1\{(C_6H_5)SiO_{3/2}\}_{10}\{SiO_{4/2}\}_4$, $\{(CF_3)C_2H_4SiO_{3/2}\}_3\{F(CF_2)_8C_2H_4SiO_{3/2}\}_1\{(CH_3)_3SiO_{1/2}\}_{10}\{(C_6H_5)SiO_{2/2}\}_{10}$, $\{(CF_3C_2H_4)_2SiO_{2/2}\}_2\{(CH_3)_3SiO_{1/2}\}_8\{(C_6H_5)_2SiO_{2/2}\}_8\{SiO_{4/2}\}_2$, $\{F(CF_2)_8C_2H_4SiO_{3/2}\}_1\{(CH_3)_3SiO_{1/2}\}_8\{(C_6H_5)SiO_{3/2}\}_8\{SiO_{4/2}\}_4$, and $\{(CF_3)C_2H_4SiO_{3/2}\}_2\{F(CF_2)_4C_2H_4SiO_{3/2}\}_1\{F(CF_2)_8C_2H_4SiO_{3/2}\}_1\{(CH_3)_3SiO_{1/2}\}_5\{(C_6H_5)_2SiO_{2/2}\}_{15}$.

The fluorine-modified organic silicone resin employed in the present invention can be produced by a conventional process for producting organopolysiloxanes. The conventional process includes the processes disclosed in Japanese Patent Publication Nos. 26-2696 and 28-6297; the siloxane polymer synthesis process described by Walter Noll: "Chemistry and Technology of Silicones", Chapter 5, p.191 (Academic Press, Inc., 1968). For example, an organic silicone resin is synthesized by dissolving an organoalkoxysilane or an organohalogenosilane in an organic solvent, hydrolyzing and condensing the silane compound in the presence of an acid or a base, and removing the solvent.

The present invention is described below with reference to an example of an electrophotographic photosensitive member having a charge-transporting layer containing a fluorine-modified organic silicone resin.

The support for the electrophotographic photosensitive member may be constituted of a material which is electroconductive by itself such as aluminum, aluminum alloys, copper, zinc, stainless steel, chromium, titanium, nickel, magnesium, indium, gold, platinum, silver, and iron; a dielectric material such as a plastic material having a vapor-deposited electroconductive coating layer of aluminum, indium oxide, tin oxide, or gold; or a plastic or paper sheet having electroconductive fine particles dispersed therein. The electroconductive support should be uniform in electroconductivity and have a smooth surface. The surface roughness of the support is preferably not more than 0.3 $\mu$m since the surface roughness affects greatly the uniformity of the subbing layer, the charge-generating layer, and the charge-transporting layer formed thereon.

In particular, an electroconductive layer can readily be formed by applying a dispersion of electroconductive fine particles in a binder onto a support. The support having such an electroconductive layer has a uniform surface, and is useful. The electroconductive fine particles has a primary particle diameter of not more than 100 nm, preferably not more than 50 nm. The material for the electroconductive fine particles includes electroconductive zinc oxide, electroconductive titanium oxide, Al, Au, Cu, Ag, Co, Ni, Fe, carbon black, ITO, tin oxide, indium oxide, and indium. The fine particles may be insulating particles coated with an electroconductive material shown above. The electroconductive fine particulate material is used in such an amount that the volume resistivity of the electroconductive layer is made sufficiently low, preferably the resistivity being not higher than $1\times10^{10}$ Ωcm, more preferably not higher than $1\times10^{8}$ Ωcm.

Between the electroconductive support and the photosensitive layer, a subbing layer may be provided which has an injection inhibiting function and an adhesive function. The material for forming the subbing layer includes casein, polyvinyl alcohol, nitrocellulose, ethylene-acrylic acid copolymer, polyvinylbutyral, phenol resins, polyamides, polyurethane resins, and gelatin. The thickness of the subbing layer ranges preferably from 0.1 to 10 μm, more preferably from 0.3 to 3 μm.

The photosensitive layer may be of a single layer structure, or may be a laminate of a charge-generating layer and a charge-transporting layer formed in this order, or a charge-transporting layer and a charge-generating layer formed in this order on a support.

The photosensitive layer of a single layer structure can be prepared by mixing a charge-generating material, a charge-transporting material, a fluorine-modified silicone resin represented by the aforementioned formula (I), and a binder resin in a solvent, and forming a film by a usual coating method.

In the formation of the photosensitive layer constituted of a charge-generating layer and a charge-transporting layer, the charge-generating layer is formed by mixing at least a charge-generating material and a binder resin in a solvent, and applying the mixture by a conventional coating method to form a film; and the charge-transporting layer is formed by mixing at least a charge-transporting material and a binder resin in a solvent, and applying the mixture by a conventional coating method to form a film. The fluorine-modified organic resin represented by the formula (I) is incorporated in the layer remote from the support in the present invention.

The charge-generating material includes selenium-tellurium, pyrylium dyes, thiopyrylium dyes, phthalocyanine pigments, anthanthrone pigments, dibenzopyrenequinone pigments, pyranthrone pigments, trisazo pigments, disazo pigments, azo pigments, indigo pigments, quinacridone pigments, cyanine pigments, and the like.

The charge-transporting material is classified into two groups: electron-transporting compounds and positive hole-transporting compounds.

The electron-transporting compounds include electron-accepting compounds such as 2,4,7-trinitrofluorenone, 2,4,5,7-tetranitrofluorenone, chloranil, tetracyanoquinodimethane, and alkyl-substituted diphenoquinones, and polymerizates of the electron-accepting compound. The positive hole-transporting compounds include polynuclear aromatic compounds such as pyrene, and anthracene; heterocyclic compounds such as carbazole, indole, oxazole, thiazole, oxathiazole, pyrazole, pyrazoline, thiadiazole, and triazole; hydrazones such as p-diethylaminobenzaldehyde-N,N-diphenylhydrazone, and N,N-diphenylhydrazino-3-methylidene-9-ethylcarbazole; styryl compounds such as α-phenyl-4'-N,N-diphenylaminostilbene, and 5-(4-(di-p-tolylamino) benzylidene)-5H-dibenzo(a,d)cycloheptene; benzidine compounds; triarylamines; and polymers having the radicals of the above compound in the main chain or the side chain (e.g., poly-N-vinylcarbazole, polyvinylanthracene, etc.).

The binder resin for the respective layers includes polymers and copolymers of vinyl compounds such as styrene, vinyl acetate, vinyl chloride, acrylate esters, methacrylate esters, vinylidene fluoride, and trifluoroethylene; polyvinyl alcohol, polyvinylacetals, polycarbonates, polyesters, polysulfones, polyphenylene oxides, polyurethane resins, cellulose resins, phenol resins, melamine resins, organic silicone resins, and epoxy resins.

The photosensitive layer of a single layer structure contains the fluorine-modified organic silicone resin at a content ranging preferably from 5% to 70%, more preferably from 10% to 50% by weight based on the solid matter thereof. At a smaller content of the fluorine-modified organic silicone resin, the decrease of the surface energy of the layer can be insufficient, or the electric durability can be low, whereas at a higher content thereof, the mechanical strength and the charge-transporting ability of the photosensitive layer can be low. The charge-generating material is contained in the photosensitive layer at a content ranging preferably from 3% to 30% by weight based on the solid matter thereof. The charge-transporting material is contained in the photosensitive layer at a content ranging preferably from 20% to 70% by weight based on the solid matter thereof.

The photosensitive layer constituted of a charge-generating layer and a charge-transporting layer contains the fluorine-modified organic silicone resin at a content ranging preferably from 5% to 70%, more preferably from 10% to 50% by weight based on the solid matter in the surface layer. At a smaller content of the fluorine-modified organic silicone resin, the effects of the present invention is not exhibited satisfactorily, whereas at a higher content thereof, the mechanical strength can be insufficient. The charge-generating layer of the photosensitive layer contains the charge-generating material at a content ranging preferably from 20% to 80%, more preferably from 30% to 70%, by weight based on the solid matter thereof. The charge-transporting layer of the photosensitive layer contains the charge-transporting material at a content ranging preferably from 20% to 70% by weight based on the solid matter of the charge-transporting layer.

The photosensitive layer of a single layer structure has a thickness ranging preferably from 3 to 40 μm. The photosensitive layer of a laminated structure has a charge-generating layer of a thickness ranging preferably from 0.05 to 1.0 μm, more preferably from 0.1 to 0.5 μm, and a charge-transporting layer of a thickness ranging preferably from 1 to 30 μm, more preferably from 3 to 20 μm.

On the photosensitive layer, a protective layer may be provided, if necessary. The protective layer on the photosensitive layer contains the fluorine-modified organic silicone resin represented by the aforementioned average unit formula (I) at a content of preferably 10% to 80%, more preferably 20% to 60% by weight based on the solid matter thereof. At a lower content of the fluorine-modified organic silicone resin, the effects of the present invention cannot be sufficiently exhibited, whereas the mechanical strength of the protection layer can be insufficient.

The protective layer is formed by applying and drying a solution of the fluorine-modified organic silicone resin and a binder resin in a suitable solvent onto a photosensitive layer. The binder resin includes polyvinylbutyral, polyester, polycarbonate (e.g., polycarbonate Z, modified polycarbonate, etc.), nylon, polyimide, polyarylate, polyurethane, styrene-butadiene copolymers, styrene-acrylate copolymers, and styrene-acrylonitrile copolymers. The protective layer has a thickness ranging preferably from 0.05 to 20 μm. The protective layer may contain a particulate electroconductive material, a UV absorbing agent, or the like. The preferred particulate electroconductive material includes particulate metal oxide such as particulate tin oxide.

An electrophotographic apparatus is described which employs an electrophotographic photosensitive member of the present invention.

In FIG. 1, a drum-shaped photosensitive member 1 of the present invention is driven to rotate in the direction shown by an arrow mark around an axis 1*a* at a prescribed peripheral speed. During the rotation, the regions of the peripheral surface successively pass through the processes below. A region of the photosensitive member 1 is electrically charged uniformly at a prescribed positive or negative potential at the peripheral surface by means of a charging means 2. Then the charged region is subjected to light image exposure L (slit exposure or laser beam scanning light exposure) at a light exposure zone 3 by a light image exposure means not shown in the drawing to successively form a latent image corresponding to the projected light image on the peripheral face of the photosensitive member with its rotation. The formed latent image is developed with a toner by a development means 4. The developed toner image is successively transferred by a corona transfer means 5 onto the face of a recording medium 9 fed synchronously with the rotation of the photosensitive member 1 between the photosensitive member 1 and the transfer means 5 by a paper-sheet feeder not shown in the drawing. The recording medium 9 having received the transferred image is separated from the surface of the photosensitive member, and is introduced to an image-fixing means 8 to have the image fixed. Then the recording medium is delivered as a copy out of the apparatus. The surface of the region of the photosensitive member 1 after the image transfer is cleaned by a cleaning means 6 to remove any residual toner, and subjected to charge-eliminating treatment by means of a pre-exposure means 7 for subsequent image formation. A corona charging apparatus is widely used as the charging means 2 for uniform charging of the photosensitive member 1.

Figure 2:
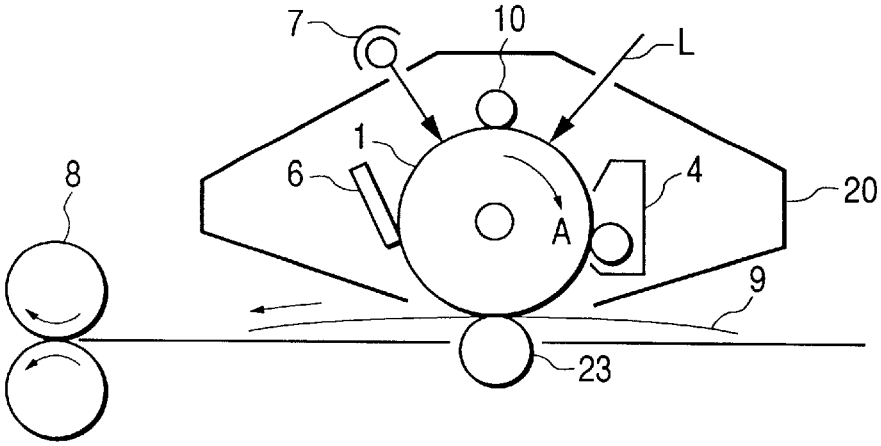
FIG. 2 is a schematic front view of another example of the electrophotographic apparatus of the present invention.
Figure 3:
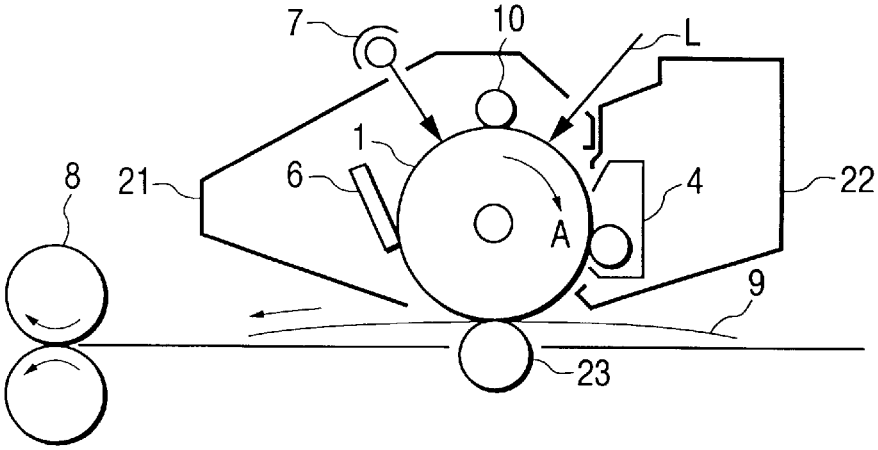
FIG. 3 is a schematic front view of still another example of the electrophotographic apparatus of the present invention.

As shown in FIG. 2 and FIG. 3, the photosensitive member 1 may be electrically charged by a direct charging member 10 brought into contact with it. This charging method is hereinafter referred to as "direct charging". In the apparatus shown in FIG. 2 and FIG. 3, the toner image on the photosensitive member 1 is transferred onto a recording medium 9 by a direct charging means 23. More specifically, a potential is applied to the direct charging member 23, and the toner image on the photosensitive member 1 is transferred onto the recording medium 9 by contact with the direct charging member 23.

The apparatus shown in FIG. 2 is an electrophotographic apparatus unit which is composed of at least a photosensitive member 1, a direct charging member 10, and a development means 4 placed in a vessel 20, and this apparatus unit is constituted so as to be detachable from the main apparatus by use of a guiding means such as a rail. The cleaning means 6 may be placed, or not placed in the vessel 20.

The apparatus shown in FIG. 3 comprises a first electrophotographic apparatus unit composed of at least a photosensitive member 1, and a direct charging member 10 placed in a first vessel 21, and a second electrophotographic apparatus unit composed of at least a development means 4 placed in a second vessel, the first apparatus unit and the second apparatus unit being detachable from the main body of the electrophotographic apparatus. The cleaning means 6 may be placed or not placed in the vessel 21.

In recent years, the demand for resolution and gradation of the image is becoming severer for the electrophotographic image forming apparatus. Investigations have been made to meet the above demand. As the results, the inventors of the present invention discovered that in an electrophotographic image forming apparatus in which a beam of light is projected to form a latent image, there is a certain relation between the gradation reproducibility and the product of the thickness of the photosensitive layer of the photosensitive member and the projected light spot area. Specifically, 400 dpi and 256 gradation can be realized by controlling the product of the spot area and photosensitive layer thickness of the photosensitive member to be not more than 20000 $\mu m^3$. This means that in general, the photosensitive layer thickness, chiefly the charge-transporting layer, of the photosensitive member using the realizable finest light spot is suitably not more than 12 $\mu$m. Thus, the smaller thickness of the photosensitive layer is desired. On the other hand, the photosensitive layer thickness of 1 $\mu$m or more, preferably 3 $\mu$m or more, is desired for prevention of pinhole formation and sensitivity drop at the same charging potential.

Figure 4:
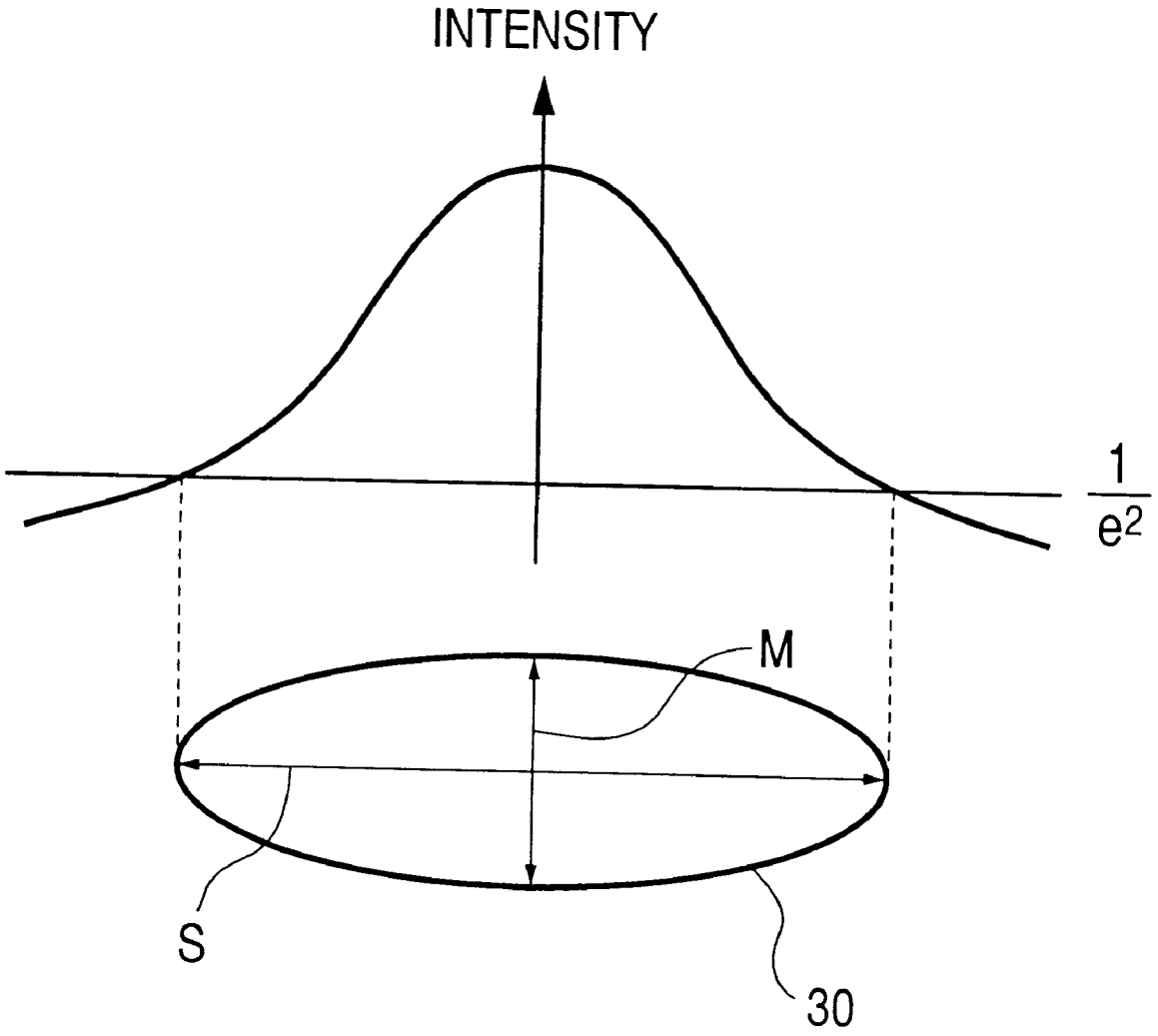
FIG. 4 shows the relation between the light intensity distribution in an irradiation light beam and a spot area.

As shown in FIG. 4, the spot area of the light beam 30 is the area of the region in which the intensity of the light is not lower than $1/e^2$ times the peak intensity. The useful light beam includes light of semiconductor laser scanning, light of a solid scanner such as LED, and liquid crystal shutter. The light intensity distributes according to Gauss distribution, Lorentz distribution, or other types of distribution. Regardless of the light intensity distribution, the spot area is the area of the region in which the intensity of the light is not lower than $1/e^2$ times the peak intensity. The light spot is generally in an ellipsoidal shape as shown in FIG. 4, where M represents the spot diameter in the main scanning direction, and S represents the spot diameter of the auxiliary scanning direction.

Other examples of the electrophotographic apparatus of the present invention are described with reference to FIG. 5 and FIG. 6.

Figure 5:
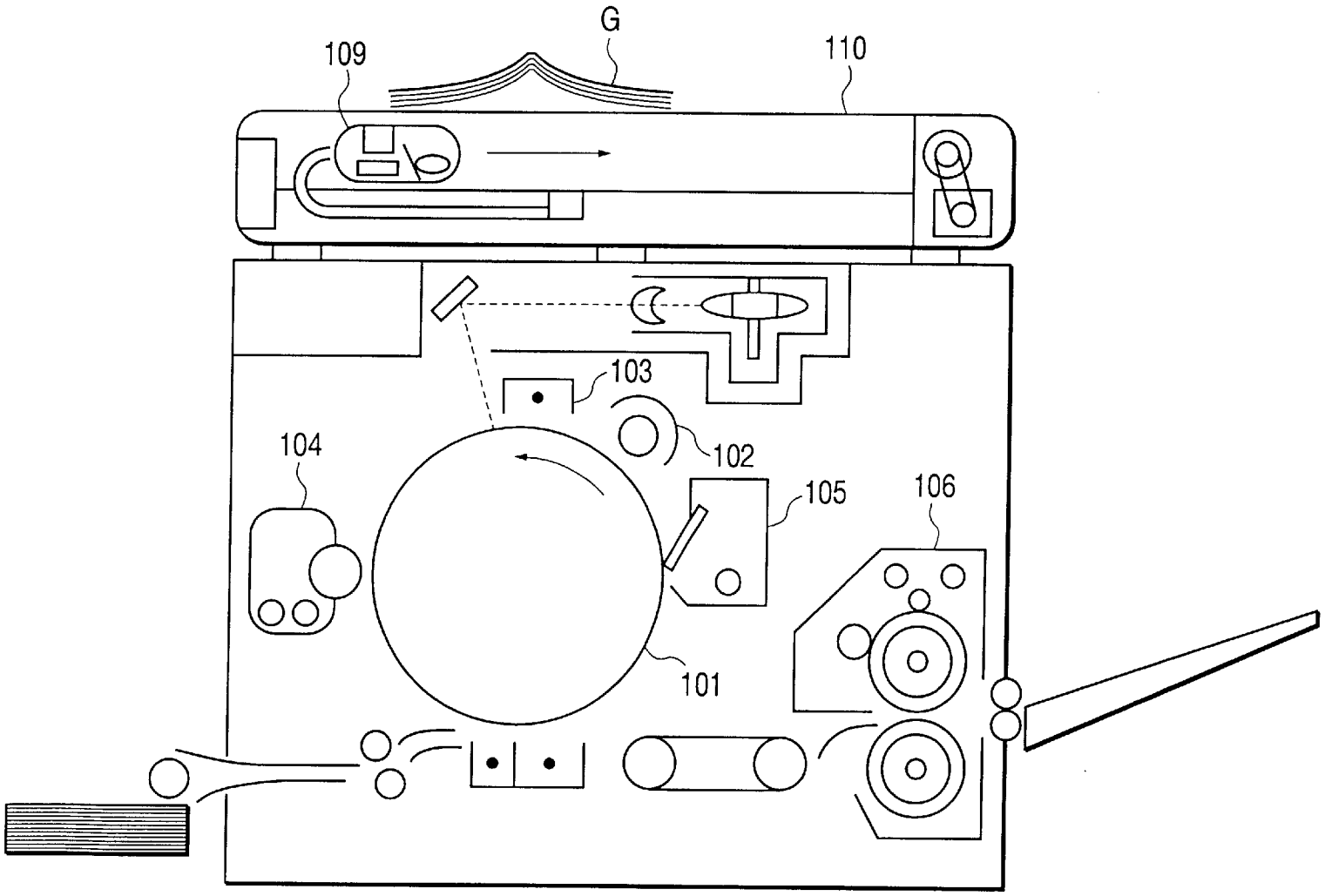
FIG. 5 is a schematic front view of a further example of the electrophotographic apparatus of the present invention.

In FIG. 5, an original copy G is placed on an original copy holder 110 with the face to be copied being directed downward. Copying operation is started by pressing a start button. A unit 109 comprising an original-irradiating lamp, a short focus lens array, and a CCD sensor which are combined together, scans the original copy with the irradiation light beam. The projected scanning light is formed into an image by the short focus lens array, and is introduced to the CCD sensor. The CCD sensor is constituted of a light-receiving portion, a transmission portion, and an output portion. In the CCD light-receiving portion, the optical signals are converted to electric signals. The converted signals are synchronized with a clock pulse and are transmitted successively to the output portion. In the output portion, the charge signals are converted to voltage signals, amplified, reduced in impedance, and output. The obtained analog signals are converted to digital signals, and are further treated for image formation to optimize the resolution and gradation for the desired image characteristics. The treated digital signals are transmitted to a printer portion. In the printer portion, a latent image is formed in accordance with the image signals as follows. The photosensitive drum 101 rotates around a center supporting axis at a prescribed peripheral speed. In the process of rotation, the drum is positively or negatively charged uniformly at a prescribed voltage by a charging device 103. The uniformly charged surface is scanned with a light beam of a solid laser element turned on and off in corresponding with the image signal by means of a polygon mirror rotating at a high speed to form a latent image successively on the face of the photosensitive drum 101 corresponding to the original copy. The apparatus is provided with a pre-exposure means 102, a charging means 103, a development means 104, a cleaning means 105, and a fixing means 106.

Figure 6:
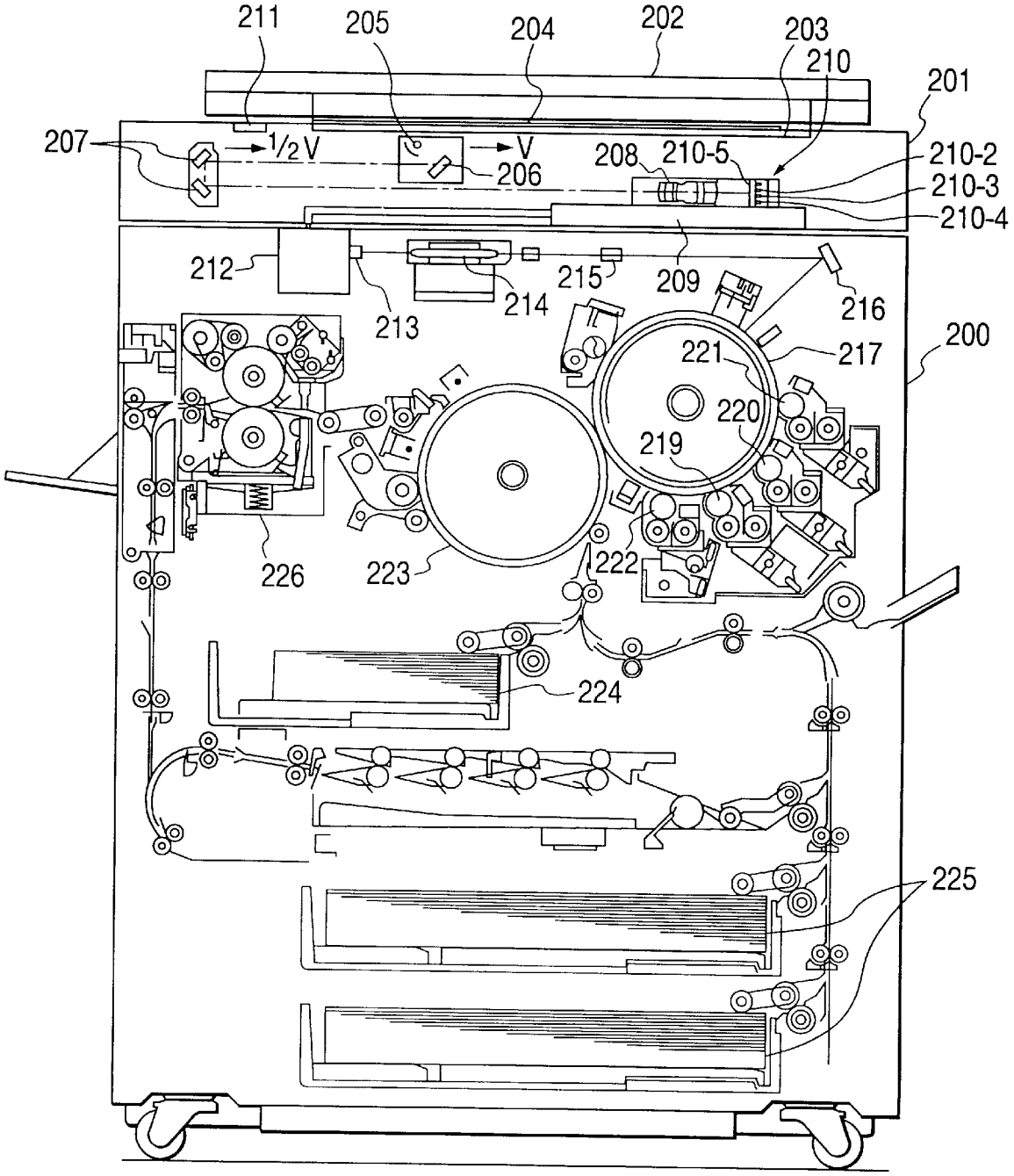
FIG. 6 is a schematic front view of a still further example of the electrophotographic apparatus of the present invention.

FIG. 6 illustrates a color copying machine of the present invention.

In FIG. 6, an image scanner potion 201 reads the original copy and converts the information into digital signals. A printer portion 200 outputs the image having been read by an image scanner 201 in full color onto a paper sheet.

In the image scanner portion 201, an original copy-pressing plate 202 serves to fix an original copy 204 on an original copy holding glass plate 203 (hereinafter referred to as a platen). The original copy 204 is irradiated with light from an halogen lamp 205. The light reflected by the original copy 204 is introduced to mirrors 206, 207, and forms an image through a lens 208 on a three-line sensor 210 constituted of three CCD line sensors (hereinafter referred to as a CCD). The CCD 210 separates the full-color optical information from the original copy into color components of red (R), green (G), and blue (B), and transmits the color components to a signal treating portion 209. The halogen lamp 205 and the mirror 206 moves at a speed of v, and the mirror 208 moves at a speed of (1/2)v mechanically in a direction (hereinafter "auxiliary scanning direction") perpendicular to the electrical scanning direction (hereinafter "main scanning direction") to scan the entire face of the original copy.

A standard white board 211 is employed at shading correction to produce data for correcting the read-out data of the line sensors 210-2, 210-3, and 210-4 corresponding respectively to the components of R, G, and B. This standard white board has uniform spectral reflection characteristics to visible light. The output data of the R, G, and B visible sensors 210-2, 210-3, and 210-4 are corrected by use of the standard white board.

The signal treating portion 209 treats electrically the signal to separate the signals into components of magenta (M), cyan (C), yellow (Y), and black (Bk), and transmits them to a printer portion 200. For one scanning of the original copy in the image scanning portion, respective color components of M, C, Y, and Bk are transmitted successively to the printer 200 for one color-picture image formation by four separate color scanning steps.

The image signals of M, C, Y, and Bk from the image scanning portion 201 are transmitted to a laser driver 212. The laser driver 212 modulates and drives a semiconductor laser 213 in accordance with the image signal. The laser light is allowed to scan a photosensitive drum 217 through a polygon mirror 214, an f-θ lens 215, and a mirror 216.

Development devices 219–222 are constituted of a magenta development device 219, a cyan development device 220, a yellow development device 221, and a black development device 222. The four development devices are successively brought into contact with the photosensitive drum to develop the latent images of M, C, Y and Bk formed on the photosensitive drum 217 with the corresponding toner. Onto a transfer drum 223, a paper sheet is delivered from a paper sheet cassette 224, or 225. The toner image developed on the photosensitive drum 217 is transferred onto the paper sheet. After successive transfer of the four color images of M, C, Y, and Bk, the paper sheet is passed through a fixation unit 226 to have the image fixed, and is driven out of the apparatus.

EXAMPLES

The fluorine-modified organic silicone resins were synthesized as shown below. In Examples and Comparative Examples, the unit "part(s)" is based on weight unless otherwise specified.

Synthesis Example 1

A mixture of 24 g of water and 90 g of toluene was placed in a flask. To the mixture, a liquid mixture of 23 g of heptadecafluorodecyltrichlorosilane represented by the formula $C_8F_{17}C_2H_4SiCl_3$, 101 g of diphenyldichlorosilane, and 120 g of toluene was added dropwise with stirring.

After completion of the addition, the resulting mixture was stirred further for 2 hours. On standing, the aqueous layer was separated, and the obtained organic solvent layer was washed with pure water, an aqueous 10% (weight) sodium bicarbonate solution, and pure water repeatedly in this order. After the washing, the organic solvent was removed by heating to produce 87 g of a fluorine-modified organic silicone resin represented by the formula:

$$\{F(CF_2)_8C_2H_4SiO_{3/2}\}_x\{(C_6H_5)_2SiO_{2/2}\}_y$$

where x is 1 on average, and y is 10 on average. This resin was a white solid having a softening point of 70° C., and a weight-average molecular weight of $8.3\times10^4$.

Synthesis Example 2

A mixture of 24 g of water and 70 g of toluene was placed in a flask. To the mixture, a liquid mixture of 23 g of heptadecafluorodecyltrichlorosilane represented by the formula $C_8F_{17}C_2H_4SiCl_3$, 71 g of diphenyldichlorosilane, 25 g of phenyltrichlorosilane, and 120 g of toluene was added dropwise with stirring.

After completion of the addition, the resulting mixture was stirred further for 2 hours. On standing, the aqueous layer was separated, and the obtained organic solvent layer was washed with pure water, an aqueous 10% (weight) sodium bicarbonate solution, and pure water repeatedly in this order. After the washing, the organic solvent was removed by heating to produce 82 g of a fluorine-modified organic silicone resin represented by the formula:

$$\{F(CF_2)_8C_2H_4SiO_{3/2}\}_x\{(C_6H_5)_2SiO_{2/2}\}_{y1}\{(C_6H_5)SiO_{3/2}\}_z$$

where the ratio of x:y:z is 1:7:3 on average. This resin was a white solid having a softening point of 30–40° C., and a weight-average molecular weight of $1.1\times10^4$.

Synthesis Example 3

$$\{F(CF_2)_4C_2H_4SiO_{3/2}\}_x\{(CH_3)_2SiO_{2/2}\}_{y1}\{(C_6H_5)SiO_{3/2}\}_{y2}$$

A mixture of 10 g of water, 3 g of isopropanol, and 20 g of toluene was placed in a flask. To the mixture, a liquid mixture of 11.4 g of $C_4F_9C_2H_4SiCl_3$, 2.6 g of $(CH_3)_2SiCl_2$, 27.5 g of phenyltrichlorosilane, and 30 g of toluene was added dropwise with stirring.

After completion of the addition, the mixture was stirred further for 2 hours. On standing, the aqueous layer was separated, and the obtained organic solvent layer was washed with pure water, an aqueous 4% (weight) sodium bicarbonate solution, and pure water repeatedly in this order. After the washing, the organic solvent was removed by heating to produce 21 g of a fluorine-modified organic silicone resin represented by the formula:

$$\{F(CF_2)_4C_2H_4SiO_{3/2}\}_x\{(CH_3)_2SiO_{2/2}\}_y\{(C_6H_5)SiO_{3/2}\}_{y2}$$

where x is 1 on average, y1 is 1 on average, and y2 is 6 on average. This resin was a white solid having a softening point of 50–60° C., and a weight-average molecular weight of $4.9\times10^4$.

Synthesis Example 4

$$\{(CF_3)C_2H_4SiO_{3/2}\}_{x1}\{F(CF_2)_8C_2H_4SiO_{3/2}\}_{x2}\{(CH_3)_3SiO_{1/2}\}_{y1}\{(C_6H_5)_2SiO_{2/2}\}_{y2}$$

A mixture of 20 g of water, and 90 g of toluene was placed in a flask. To the mixture, a liquid mixture of 4.7 g of $(CF_3)C_2H_4SiCl_3$, 11.6 g of $C_8F_{17}C_2H_4SiCl_3$, 5.6 g of $(CH_3)_3SiCl$, 75.9 g of diphenyldichlorosilane, and 120 g of toluene was added dropwise with stirring.

After completion of the addition, the mixture was stirred further for 2 hours. On standing, the aqueous layer was separated, and the obtained organic solvent layer was washed with pure water, an aqueous 4% (weight) sodium bicarbonate solution, and pure water repeatedly in this order. After the washing, the organic solvent was removed by heating to produce 61 g of a fluorine-modified organic silicone resin represented by the formula:

$$\{(CF_3)C_2H_4SiO_{3/2}\}_{x1}\{F(CF_2)_8C_2H_4SiO_{3/2}\}_{x2}\{(CH_3)_3SiO_{1/2}\}_{y1}\{(C_6H_5)_2SiO_{2/2}\}_{y2}$$

where x1 is 1 on average, x2 is 1 on average, y1 is 3 on average, and y2 is 13 on average. This resin was a white solid having a softening point of 60–70° C., and a weight-average molecular weight of $8.4\times10^3$.

Synthesis Example 5

$$\{F(CF_2)_8C_2H_4SiO_{3/2}\}_x\{(CH_3)_3SiO_{1/2}\}_{y1}\{(C_6H_5)_2SiO_{2/2}\}_{y2}\{SiO_{4/2}\}_{y3}$$

A mixture of 24 g of aqueous 36% (weight) hydrochloric acid, and 100 g of toluene was placed in a flask. To the mixture, a liquid mixture of 11.5 g of $C_8F_{17}C_2H_4SiCl_3$, 11.0 g of $(CH_3)_3SiCl$, 25.1 g of diphenyldichlorosilane, 20.4 g of $Si(OC_2H_5)_4$, and 100 g of toluene was added dropwise with stirring.

After completion of the addition, the mixture was stirred further for 2 hours. On standing, the aqueous layer was separated, and the obtained organic solvent layer was washed pure water, an aqueous 4% (weight) sodium bicarbonate solution, and pure water repeatedly in this order. After the washing, the organic solvent was removed by heating to produce 37 g of a fluorine-modified organic silicone resin represented by the formula:

$$\{F(CF_2)_8C_2H_4SiO_{3/2}\}_x\{(CH_3)_3SiO_{1/2}\}_{y1}\{(C_6H_5)_2SiO_{2/2}\}_{y2}\{SiO_{4/2}\}_{y3}$$

where x is 1 on average, y1 is 5 on average, y2 is 5 on average, and y3 is 6 on average. This resin was a white solid having a softening point of not lower than 200° C., and a weight-average molecular weight of $4.5\times10^3$.

Example 1

The resin prepared in Synthesis Example 1, 4-[2-(triethoxysilyl)ethyl]triphenylamine, and a polycarbonate resin (trade name: Z-200, Mitsubishi Gas Chemical Co., Inc.) were dissolved in THF in a solid content of 20%, 40%, and 40% by weight.

The solution was applied onto a glass plate by a bar coater, and was dried at 120° C. for one hour, obtaining a uniform transparent film of 10 μm thick. The uniformity of the film was confirmed by microscopic examination.

This sample was transparent, and showed an absorbance of 0.001 per μm thickness at 600 nm by spectrophotometry. The contact angle with water was 105°, showing a lower surface energy of the sample.

Example 2

The resin prepared in Synthesis Example 2, 4-[2-(triethoxysilyl)ethyl]triphenylamine, and a polycarbonate resin (trade name: Z-200, Mitsubishi Gas Chemical Co., Inc.) were dissolved in THF in a solid content of 20%, 40%, and 40% by weight.

The solution was applied onto a glass plate by a bar coater, and was dried at 120° C. for one hour, obtaining a uniform transparent film of 10 μm thick. The uniformity of the film was confirmed by microscopic examination.

This sample was transparent, and showed an absorbance of 0.001 per μm thickness at 600 nm by spectrophotometry. The contact angle with water was 107°, showing a lower surface energy of the sample.

Example 3

The resin prepared in Synthesis Example 2, 4-[2-(triethoxysilyl)ethyl]triphenylamine, and a polycarbonate resin (trade name: Z-200, Mitsubishi Gas Chemical Co., Inc.) were dissolved in THF in a solid content of 20%, 40%, and 40% by weight, respectively.

The solution was applied onto an aluminum plate of 50 μm thick by a bar coater, and was dried at 120° C. for one hour, obtaining a uniform transparent film of 20 μm thick. The uniformity of the film was confirmed by microscopic examination.

An electroconductive rubber roller was brought into contact with the resin film of this sample, and using the aluminum plate as an earth, an AC voltage of 1500 Hz having a peak-to-peak voltage of 1500 V superposed on a DC voltage of −600 V was applied to the electroconductive rubber roller for one hour to test the deterioration caused by the electric charging. The resistance to discharge was evaluated by the depth of a hollow formed by electric discharge in the vicinity of the portion at which the roller was brought into contact with the resin film. The depth of the hollow formed on the film in this Example was as small as 0.3 μm.

Example 4

A mirror-polished aluminum cylinder of 60 mm in outside diameter was coated with alumite by anodic oxidation. This cylinder was used as the electroconductive support.

A coating liquid for a charge-generating layer was prepared by dispersing 5 parts of the bisazo pigment shown by the formula below in a solution of 2 parts of polyvinylbenzal (benzal-modified degree of 75% of higher) in 95 parts of cyclohexanone by a sand mill for 20 hours. On the subbing layer (or alumite) formed above, the charge-generating layer was formed by applying this liquid dispersion by immersion coating in a dry thickness of 0.2 μm.

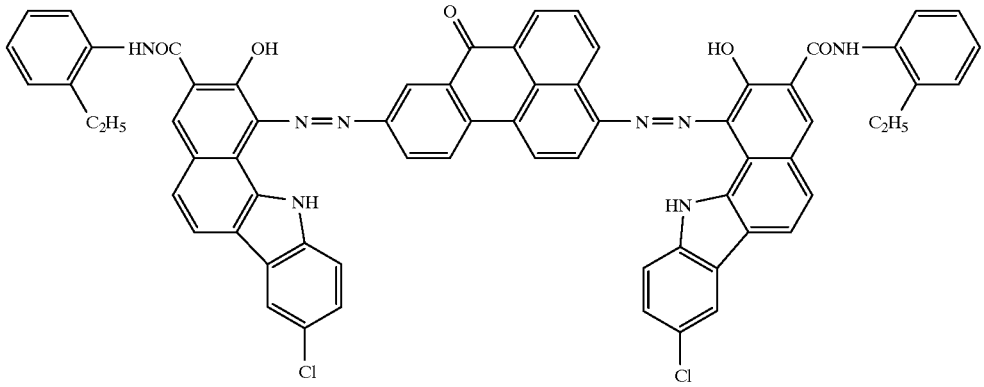

A coating liquid for a charge-transporting layer was prepared by dissolving 5 parts of the triarylamine represented by the structural formula below, 2.5 parts of the resin prepared in Synthesis Example 1, and 5 parts of a polycarbonate resin (trade name; Z-400, Mitsubishi Gas Chemical Co., Inc.) in 70 parts of tetrahydrofuran. This solution was applied on the charge-generating layer in a dry thickness of 12 μm by immersion coating to form the charge-transporting layer.

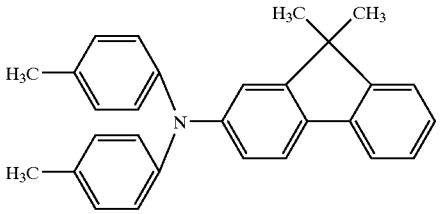

The obtained photosensitive member was tested for the electrophotographic characteristics at a wavelength of 680 nm by charging at −700 V. $E_{1/2}$ (light exposure to decrease the charged voltage to −350 V) was 1.2 μJ/cm$^2$, and the residual potential was 48 V, thus the results were good.

This electrophotographic photosensitive member was set on a digital copying machine GP55 (roller charging system, manufactured by Canon K.K.) which had been modified to give the aforementioned irradiation spot diameter. With this apparatus, the copied image was evaluated at the initial charging −400 V. The image output was sufficiently uniform from the initial stage through 5000-sheet copying in the duration test; the gradation reproducibility was excellent to give 256 gradations at 400 dpi; and the abrasion of the photosensitive member was as small as 0.4 μm per 1000-sheet duration test.

The contact angle with water on the surface of the photosensitive member was found to be 104° at the initial stage, and 98° at the time of 5000-sheet copying.

Example 5

The resin prepared in Synthesis Example 1, 4-[2-(triethoxysilyl)ethyl]triphenylamine, and a polycarbonate resin (trade name: Z-200, Mitsubishi Gas Chemical Co., Inc.) were dissolved in THF in a solid content of 20%, 40%, and 40% by weight, respectively.

The solution was applied onto a aluminum plate of 50 μm thick by a bar coater, and was dried at 120° C. for one hour, obtaining a uniform transparent film of 20 μm thick. The uniformity of the film was confirmed by microscopic examination.

An electroconductive rubber roller was brought into contact with the resin film of this sample, and using the aluminum plate as an earth, an AC voltage of 1500 Hz having a peak-to-peak voltage of 1500 V superposed on a DC voltage of −600 V was applied to the electroconductive rubber roller for one hour to test the deterioration caused by the electric charging. The resistance to discharge was evaluated by the depth of a hollow formed by electric discharge in the vicinity of the portion at which the roller was brought into contact with the resin film. The depth of the hollow formed on the film in this Example was as small as 0.1 μm.

Example 6

A mirror-polished aluminum cylinder of 80 mm in outside diameter coated with alumite by anodic oxidation was used, on which a charge-generating layer and a charge-transporting layer were formed in the same manner as in Example 4 to prepare an electrophotographic photosensitive member.

This electrophotographic photosensitive member was set on a digital copying machine CLC500 (corona charging system, manufactured by Canon K.K.) which had been modified to give the aforementioned irradiation spot diameter. With this apparatus, the copied image was evaluated at the initial charging −400 V. The image output was sufficiently uniform from the initial stage through the 5000-sheet copying duration test; the gradation reproducibility was excellent to give 256 gradations at 400 dpi; and the abrasion of the photosensitive member was as small as 0.2 μm per 1000-sheet duration test.

The contact angle with water on the surface of the photosensitive member was found to be 104° at the initial stage, and 94° at the time of 5000-sheet copying.

Example 7

A liquid dispersion for an electroconductive layer was prepared by dispersing 200 parts of ultrafine particulate electroconductive barium sulfate (primary particle diameter: 50 nm) and 3 parts of particulate silicone resin (average particle diameter: 2 μm) in a solution of 167 parts of a phenol resin (trade name: Priophen, Dainippon Ink and Chemicals, Inc.) in 100 parts of methylcellosolve. This dispersion was applied on a drawn aluminum cylinder of 30 mm in outside diameter by immersion coating to form an electroconductive layer in a dry thickness of 15 μm.

A solution of 5 parts of alcohol-soluble copolymer nylon (trade name: Amylan CM-8000, Toray Industries, Inc.) in 95 parts of methanol was applied by immersion coating and dried at 80° C. for 10 minutes to form a subbing layer of 1 μm thick.

A dispersion for a charge-generating layer was prepared by dispersing 5 parts of I-type oxytitanium phthalocyanine pigment in a solution of 2 parts of polyvinylbenzal (benzal-modified degree: 75% or higher) in 95 part of cyclohexanone by a sand mill for 2 hours. This dispersion was applied onto the above subbing layer by immersion coating to form a charge-generating layer in a dry thickness of 0.2 μm.

A solution for a charge-transporting layer was prepared by dissolving 27.5 parts of the fluorine-modified organic silicone resin prepared in Synthesis Example 2, 55 parts of the triarylamine used in Example 4, and 55 parts of a polycarbonate resin (trade name: Z-400, Mitsubishi Gas Chemical Co., Inc.) in 70 parts of tetrahydrofuran. This solution was applied on the above charge-generating layer by immersion coating to form a charge-transporting layer in a dry thickness of 10 μm.

The contact angle with water was 105°.

The obtained photosensitive member was tested for the electrophotographic characteristics at a wavelength of 680 nm by charging at −700 V. $E_{1/2}$ (light exposure to decrease the charged voltage to −350 V) was 0.1 μJ/cm$^2$, and the residual potential was 45 V, thus the results were good.

This electrophotographic photosensitive member was set on a laser beam printer P270 having an AC roller charger (manufactured by Canon K.K.) which had been modified to give the aforementioned irradiation spot diameter. With this apparatus, an image was formed and the copied image was evaluated at the initial charging −500 V. After the 4000-sheet duration test, the abrasion of the photosensitive member was as small as 2 μm or less; the contact angle with water was 100° desirably; no image deterioration was observed; and one pixel reproducibility at a highlight portion was sufficient in input signals corresponding to 600 dpi.

Example 8

A liquid dispersion for an electroconductive layer was prepared by dispersing 200 parts of ultrafine particulate electroconductive barium sulfate (primary particle diameter: 50 nm) in a solution of 167 parts of a phenol resin (trade name: Priophen, Dainippon Ink and Chemicals, Inc.) in 100 parts of methylcellosolve. This dispersion was applied on a drawn aluminum cylinder of 30 mm in outside diameter by immersion coating in the same manner as in Example 7 to form an electroconductive layer in a dry thickness of 10 μm.

On this electroconductive support, a subbing layer of 1 μm thick, and a charge-generating layer of 0.2 μm thick were formed in the same manner as in Example 6.

A solution for a charge-transporting layer was prepared by dissolving 5 parts of the triarylamine employed in Example 4 and 5 parts of a polycarbonate resin (trade name: Z-400, Mitsubishi Gas Chemical Co., Inc.) in 70 parts of chlorobenzene. This solution was applied on the above charge-generating layer by immersion coating to form a charge-transporting layer in a dry thickness of 8 μm.

Onto the above charge-transporting layer, a resin solution prepared in Example 2 was applied by spray coating to form a film having a dry thickness of 4 μm. The formed film was dried and thermally cured at 110° C. for 2 hours to complete the photosensitive member of the present invention.

The contact angle with water was 109°.

The obtained photosensitive member was tested for the electrophotographic characteristics at a wavelength of 680 nm by charging at −700 V. $E_{1/2}$ (light exposure to decrease the charged voltage to −350 V) was 0.14 μJ/cm$^2$, and the residual potential was 39 V, thus the results were good.

This electrophotographic photosensitive member was set on a laser beam printer P270 (manufactured by Canon K.K.) which had been modified in the optical system such that a semiconductor laser of 780 nm and 100 mW was employed to give the laser spot diameter of 60×20 μm$^2$. With this laser beam printer, an image was formed and the copied image was evaluated at the initial charging −500 V. After the 4000-sheet duration test, the abrasion of the photosensitive member was as small as 2.5 μm or less; the contact angle with water was 98° desirably; no image deterioration such as black dots caused by charge injection or interference fringes was observed; and one pixel reproducibility at a highlight portion was sufficient in input signals corresponding to 600 dpi.

Example 9

A liquid dispersion for an electroconductive layer was prepared by dispersing 200 parts of ultrafine particulate electroconductive barium sulfate (primary particle diameter: 50 nm) and 3 parts of particulate silicone resin (average particle diameter: 2 μm) in a solution of 167 parts of a phenol resin (trade name: Priophen, Dainippon Ink and Chemicals, Inc.) in 100 parts of methylcellosolve. This dispersion was applied on a drawn aluminum cylinder of 30 mm in outside diameter by immersion coating to form an electroconductive layer in a dry thickness of 15 μm.

A solution of 5 parts of an alcohol-soluble copolymer nylon (trade name: Amylan CM-8000, Toray Industries, Inc.) in 95 parts of methanol was applied by immersion coating and dried at 80° C. for 10 minutes to form a subbing layer of 1 μm thick.

A dispersion for a charge-generating layer was prepared by dispersing 5 parts of I-type oxytitanium phthalocyanine pigment in a solution of 2 parts of polyvinylbenzal (benzal-modified degree: 75% or higher) in 95 part of cyclohexanone by a sand mill for 2 hours. This dispersion was applied onto the above subbing layer by immersion coating to form a charge-generating layer in a dry thickness of 0.2 μm.

A solution for a charge-transporting layer was prepared by dissolving 27.5 parts of the fluorine-modified organic silicone resin prepared in Synthesis Example 2, 55 parts of the triarylamine used in Example 4, and 55 parts of a polycarbonate resin (trade name: Z-400, Mitsubishi Gas Chemical Co., Inc.) in 70 parts of tetrahydrofuran. This solution was applied on the above charge-generating layer by immersion coating to form a charge-transporting layer in a dry thickness of 20 μm.

The contact angle with water was 105°.

The obtained photosensitive member was tested for the electrophotographic characteristics at a wavelength of 680 nm by charging at −700 V. $E_{1/2}$ (light exposure to decrease the charged voltage to −350 V) was 0.11 μJ/cm$^2$, and the residual potential was 51 V, thus the results were good.

This electrophotographic photosensitive member was set on a laser beam printer P270 having an AC roller (manufactured by Canon K.K.) which had been modified in the irradiation spot conditions as above. With this apparatus, an image was formed and the copied image was evaluated at the initial charging −500 V. After the 4000-sheet duration test, the abrasion of the photosensitive member was as small as 2 μm or less; the contact angle with water was 100° desirably; and no image deterioration was observed. However, one pixel reproducibility at a highlight portion was a little in sufficient in input signal corresponding to 600 dpi.

Example 10

A liquid dispersion for an electroconductive layer was prepared by dispersing 200 parts of ultrafine particulate electroconductive barium sulfate (primary particle diameter: 50 nm) and 3 parts of particulate silicone resin (average particle diameter: 2 μm) in a solution of 167 parts of a phenol resin (trade name: Priophen, Dainippon Ink and Chemicals, Inc.) in 100 parts of methylcellosolve. This dispersion was applied on a drawn aluminum cylinder of 30 mm in outside diameter by immersion coating to form an electroconductive layer in a dry thickness of 15 μm.

A solution of 5 parts of an alcohol-soluble copolymer nylon (trade name: Amylan CM-8000, Toray Industries, Inc.) in 95 parts of methanol was applied by immersion coating and dried at 80° C. for 10 minutes to form a subbing layer of 1 μm thick.

A dispersion for a charge-generating layer was prepared by dispersing 5 parts of I-type oxytitanium phthalocyanine pigment in a solution of 2 parts of polyvinylbenzal (benzal-modified degree: 75% or higher) in 95 parts of cyclohexanone by a sand mill for 2 hours. This dispersion was applied onto the above subbing layer by immersion coating to form a charge-generating layer in a dry thickness of 0.2 μm.

A solution for a charge-transporting layer was prepared by dissolving 47.0 parts of the fluorine-modified organic silicone resin prepared in Synthesis Example 3, 55 parts of the triarylamine used in Example 4, and 55 parts of a polycarbonate resin (trade name: Z-400, Mitsubishi Gas Chemical Co., Inc.) in 150 parts of tetrahydrofuran. This solution was applied on the above charge-generating layer by immersion coating to form a charge-transporting layer in a dry thickness of 12 μm.

The contact angle with water was 102°.

The obtained photosensitive member was tested for the electrophotographic characteristics at a wavelength of 680 nm by charging at −550 V. $E_{1/2}$ (light exposure to decrease the charged voltage to −275 V) was 0.16 μJ/cm$^2$, and the residual potential was 30 V, thus the results were good.

This electrophotographic photosensitive member was set on a laser beam printer P270 having an AC roller (manufactured by Canon K.K.) which had been modified in the irradiation spot conditions as above. With this apparatus, an image was formed and the copied image was evaluated at the initial charging −500 V. After the 4000-sheet duration test, the abrasion of the photosensitive member was as small as 2 μm or less; the contact angle with water was 90° desirably; and no image deterioration was observed.

Example 11

A liquid dispersion for an electroconductive layer was prepared by dispersing 200 parts of ultrafine particulate electroconductive barium sulfate (primary particle diameter: 50 nm) and 3 parts of particulate silicone resin (average particle diameter: 2 μm) in a solution of 167 parts of a phenol resin (trade name: Priophen, Dainippon Ink and Chemicals, Inc.) in 100 parts of methylcellosolve. This dispersion was applied on a drawn aluminum cylinder of 30 mm in outside diameter by immersion coating to form an electroconductive layer in a dry thickness of 15 μm.

A solution of 5 parts of an alcohol-soluble copolymer nylon (trade name: Amylan CM-8000, Toray Industries, Inc.) in 95 parts of methanol was applied by immersion coating and dried at 80° C. for 10 minutes to form a subbing layer of 1 μm thick.

A dispersion for a charge-generating layer was prepared by dispersing 5 parts of I-type oxytitanium phthalocyanine pigment in a solution of 2 parts of polyvinylbenzal (benzal-modified degree: 75% or higher) in 95 parts of cyclohexanone by a sand mill for 2 hours. This dispersion was applied onto the above subbing layer by immersion coating to form a charge-generating layer in a dry thickness of 0.2 μm.

A solution for a charge-transporting layer was prepared by dissolving 70 parts of the fluorine-modified organic silicone resin prepared in Synthesis Example 4, 55 parts of the triarylamine used in Example 4, and 55 parts of a polycarbonate resin (trade name: Z-400, Mitsubishi Gas Chemical Co., Inc.) in 150 parts of tetrahydrofuran. This solution was applied on the above charge-generating layer by immersion coating to form a charge-transporting layer in a dry thickness of 15 μm.

The contact angle with water was 112°.

The obtained photosensitive member was tested for the electrophotographic characteristics at a wavelength of 680 nm by charging at −700 V. $E_{1/2}$ (light exposure to decrease the charged voltage to −350 V) was 0.20 μJ/cm$^2$, and the residual potential was 40 V, thus the results were good.

This electrophotographic photosensitive member was set on a laser beam printer P270 having an AC roller (manufactured by Canon K.K.) which had been modified in the irradiation spot conditions as above. With this apparatus, an image was formed at the initial charging of −500 V and the copied image was evaluated. After the 4000-sheet duration test, the abrasion of the photosensitive member was as small as 3 μm or less; the contact angle of water was 100° desirably; and no image deterioration was observed.

Example 12

A liquid dispersion for an electroconductive layer was prepared by dispersing 200 parts of ultrafine particulate electroconductive barium sulfate (primary particle diameter: 50 nm) and 3 parts of particulate silicone resin (average particle diameter: 2 μm) in a solution of 167 parts of a phenol resin (trade name: Priophen, Dainippon Ink and Chemicals, Inc.) in 100 parts of methylcellosolve. This dispersion was applied on a drawn aluminum cylinder of 30 mm in outside diameter by immersion coating to form an electroconductive layer in a dry thickness of 15 μm.

A solution of 5 parts of an alcohol-soluble copolymer nylon (trade name: Amylan CM-8000, Toray Industries, Inc.) in 95 parts of methanol was applied by immersion coating and dried at 80° C. for 10 minutes to form a subbing layer of 1 μm thick.

A dispersion for a charge-generating layer was prepared by dispersing 5 parts of I-type oxytitanium phthalocyanine pigment in a solution of 2 parts of polyvinylbenzal (benzal-modified degree: 75% or higher) in 95 parts of cyclohexanone by a sand mill for 2 hours. This dispersion was applied onto the above subbing layer by immersion coating to form a charge-generating layer in a dry thickness of 0.2 μm.

A solution for a charge-transporting layer was prepared by dissolving 20 parts of the fluorine-modified organic silicone resin prepared in Synthesis Example 5, 55 parts of the triarylamine used in Example 4, and 55 parts of a polycarbonate resin (trade name: Z-400, Mitsubishi Gas Chemical Co., Inc.) in 150 parts of tetrahydrofuran. This solution was applied on the above charge-generating layer by immersion coating to form a charge-transporting layer in a dry thickness of 12 μm.

The contact angle with water was 108°.

The obtained photosensitive member was tested for the electrophotographic characteristics at a wavelength of 680 nm by charging at −550 V. $E_{1/2}$ (light exposure to decrease the charged voltage to −275 V) was 0.19 $\mu J/cm^2$, and the residual potential was 28 V, thus the results were good.

This electrophotographic photosensitive member was set on a laser beam printer P270 having an AC roller (manufactured by Canon K.K.) which had been modified in the irradiation spot conditions as above. With this apparatus, an image was formed at the initial charge −500 V and the copied image was evaluated. After the 4000-sheet duration test, the abrasion of the photosensitive member was as small as 3 $\mu$m or less; the contact angle of water was 93° desirably; and no image deterioration was observed.

Comparative Example 1

Fine particulate teflon (trade name: Lubron LD-1, Daikin Industries, Ltd., particle diameter: about 0.2 $\mu$m), 4-[2-(triethoxysilyl)ethyl]triphenylamine, and a polycarbonate resin (trade name: Z-200, Mitsubishi Gas Chemical Co., Inc.) were dissolved in THF in a solid content of 5%, 47.5%, and 47.5% by weight.

The solution was applied onto a glass plate by a bar coater, and dried at 120° C. for one hour, to obtaining a white-turbid film of 10 $\mu$m thick. In the film, the aggregate of the teflon particles was observed by microscopic examination.

This sample showed a light absorbance of 0.022 per $\mu$m thickness at 600 nm by spectrophotometry, and considerable light scattering was observed.

The contact angle with water was 86°, showing an insufficient lowering of the surface energy of the sample.

Comparative Example 2

Preparation of Resin Solution Containing

Methylpolysiloxane Resin as Main Constituent:

In 10 g of toluene, 10 g of a silicone resin comprised of 80 mol % of methylsiloxane unit and 20 mol % of dimethylsiloxane unit and having 1% by weight of silanol groups was dissolved into a uniform solution.

Test for Compatibility in Charge-transporting layer:

The above methylpolysiloxane resin solution, 4-[2-(triethoxysilyl)ethyl]triphenylamine, and a polycarbonate resin (trade name: Z-200, Mitsubishi Gas Chemical Co., Inc.) were dissolved in THF in a solid content of 5%, 47.5%, and 47.5% by weight.

The solution was applied onto a glass plate by a bar coater, and dried at 120° C. for one hour, obtaining a white-turbid film of 10 $\mu$m thick which was uneven (or concave and convex) in its surface. In the film, the aggregate of the teflon particles was observed by microscopic examination.

This sample showed a light absorbance of 0.05 per $\mu$m thickness at 600 nm by spectrophotometry, and considerable light scattering was observed.

The contact angle with water was 103°, showing that the surface energy of the sample was reduced.

Comparative Example 3

Preparation of Resin Solution Containing

Phenylpolysiloxane Resin as Main Constituent:

In 10 g of toluene, 12 g of a silicone resin comprised of 40 mol % of phenylsiloxane unit, 20 mol % of diphenylsiloxane unit, 20 mol % of methylsiloxane unit, and 20 mol % of dimethylsiloxane unit, and having 1% by weight of silanol groups was dissolved into a uniform solution.

Test for Compatibility in Charge-transporting layer:

The above methylpolyphenylsiloxane resin solution, 4-[2-(triethoxysilyl)ethyl]triphenylamine, and a polycarbonate resin (trade name: Z-200, Mitsubishi Gas Chemical Co., Inc.) were dissolved in THF in a solid content of 20%, 40%, and 40% by weight.

The solution was applied onto a glass plate by a bar coater, and was dried at 120° C. for one hour, to obtaining a white-turbid film of 10 $\mu$m thick.

This sample showed a light absorbance of 0.012 per $\mu$m thickness at 600 nm by spectrophotometry, and considerable light scattering was observed.

The contact angle with water was 88°, showing insufficient lowering of the surface energy of the sample.

Comparative Example 4

4-[2-(triethoxysilyl)ethyl]triphenylamine, and a polycarbonate resin (trade name: Z-200, Mitsubishi Gas Chemical Co., Inc.) were dissolved in THF in a solid content of 50%, and 50% by weight, respectively.

The solution was applied onto an aluminum plate of 50 $\mu$m thick by a bar coater, and dried at 120° C. for one hour, obtaining a uniform transparent film of 20 $\mu$m thick. The uniformity of the film was confirmed by microscopic examination.

An electroconductive rubber roller was brought into contact with the resin film of this sample, and using the aluminum plate as an earth, an AC voltage of 1500 Hz having a peak-to-peak voltage of 1500 V superposed on a DC voltage of −600 V was applied to the electroconductive roller for one hour to test the deterioration caused by the electric charging. The resistance to discharge was evaluated by the depth of a hollow formed by electric discharge in the vicinity of the portion at which the roller was brought into contact with the resin film. The depth of the concave formed on the film was as large as 1 $\mu$m.

Comparative Example 5

A solution for a charge-transporting layer was prepared by dissolving 5 parts of the triarylamine employed in Example 4 and 5 parts of a polycarbonate resin (trade name: Z-400, Mitsubishi Gas Chemical Co., Inc.) in 70 parts of chlorobenzene. This solution was applied on the above charge-generating layer by immersion coating to form a charge-transporting layer in a dry thickness of 12 $\mu$m. The photosensitive member was evaluated for image formation by means of the same laser beam printer (manufactured by Canon K.K.) as the one employed in Example 4. After 4000-sheet duration test, interference fringes and black spots were observed in the copied image; the abrasion was as large as 5 $\mu$m; the contact angle was as small as 72° unsatisfactorily; and one pixel reproducibility was insufficient and non-uniform in the highlight portion at 600 dpi.

Comparative Example 6

A liquid dispersion for an electroconductive layer was prepared by dispersing 200 parts of ultrafine particulate electroconductive barium sulfate (primary particle diameter: 50 nm) and 3 parts of particulate silicone resin (average particle diameter: 2 $\mu$m) in a solution of 167 parts of a phenol resin (trade name: Priophen, Dainippon Ink and Chemicals, Inc.) in 100 parts of methylcellosolve. This dispersion was applied on a drawn aluminum cylinder of 30 mm in outside diameter by immersion coating to form an electroconductive layer of a dry thickness of 15 $\mu$m.

A solution of 5 parts of alcohol-soluble copolymer nylon (trade name: Amylan CM-8000, Toray Industries, Inc.) in 95 parts of methanol was applied by immersion coating, and dried at 80° C. for 10 minutes to form a subbing layer of 1 μm thick.

A dispersion for a charge-generating layer was prepared by dispersing 5 parts of I-type oxytitanium phthalocyanine pigment in a solution of 2 parts of polyvinylbenzal (benzalation degree: 75% or higher) in 95 parts of cyclohexanone by a sand mill for 2 hours. This dispersion was applied onto the above subbing layer by immersion coating to form a charge-generating layer in a dry thickness of 0.2 μm.

A solution for a charge-transporting layer was prepared by dispersing and dissolving 5 parts of the triarylamine employed in Example 4, 5 parts of a polycarbonate resin (trade name: Z-400, Mitsubishi Gas Chemical Co., Inc.), and 0.5 part of fine particulate teflon in 70 parts of chlorobenzene. This solution was applied on the above charge-generating layer by immersion coating to form a charge-transporting layer in a dry thickness of 12 μm. The photosensitive member was evaluated for image formation by means of the same laser beam printer (manufactured by Canon K.K.) as the one employed in Example 4. After 4000-sheet duration test, the abrasion was about 4 μm; the contact angle was 89°, showing that the surface energy was slightly reduced; and one pixel reproducibility was insufficient and non-uniform in the highlight portion at 600 dpi from the initial stage of the duration test.

What is claimed is:

1. An electrophotographic photosensitive member having a photosensitive layer formed on a support, a surface layer of the photosensitive member containing a fluorine-modified organic silicone resin represented by the following average unit formula (I):

$$\{F(CF_2)_{a1}\text{-}Q_1\text{-}R_{1.m1}SiO_{(3-m1)/2}\}_{X1}\{F(CF_2)_{a2}\text{-}Q_2\text{-}R_{2.m2}SiO_{(3-m2)/2}\}_{X2}\cdots\{F(CF_2)_{ap}\text{-}Q_p\text{-}R_{p.mp}SiO_{(3-mp)/2}\}_{Xp}R_1'_{n1}SiO_{(4-n1)/2}\}_{y1}\{R_2'_{n2}SiO_{(4-n2)/2}\}_{y2}\cdots\{R_q'_{nq}SiO_{(4-nq)/2}\}_{yq}$$

where $R_1$ to $R_p$ and $R_1'$ to $R_q'$ are each respectively an alkyl or aryl group; $Q_1$ to $Q_p$ are each respectively an alkylene group; m1 to mp are each respectively an integer of 0–2; n1 to nq are each respectively an integer of 0 to 3; a1 to aq are each respectively an integer; x1 and y1 are each respectively a number larger than 0; and x2 to xp and y2 to yq are each respectively a number of 0 or more.

2. The electrophotographic photosensitive member according to claim 1, wherein the surface layer is a photosensitive layer.

3. The electrophotographic photosensitive member according to claim 1, wherein the surface layer is a charge-transporting layer.

4. The electrophotographic photosensitive member according to claim 1, wherein the surface layer is a charge-generating layer.

5. The electrophotographic photosensitive member according to claim 1, wherein the surface layer is a protection layer.

6. The electrophotographic photosensitive member according to claim 1, wherein $R_1$ to $R_p$ $R_1'$ $R_q'$ are each respectively a group of 1–12 carbons; $Q_1$ to $Q_p$ are each respectively a group of 2–6 carbons; and the ratio of (x1+x2+. . .xp):(y1+y2+. . .+yq) ranges from 1:20 to 1:5.

7. The electrophotographic photosensitive member according to claim 1, wherein the fluorine-modified organic silicone resin has a weight-average molecular weight ranging from 1000 to 100000.

8. An electrophotographic apparatus, comprising the electrophotographic photosensitive member as recited in claim 1, a charging means for charging the electrophotographic photosensitive member, an image exposure means for exposing the charged electrophotographic photosensitive member to image light to form an electrostatic latent image, and a development means for developing the formed electrostatic latent image with a toner.

9. A process cartridge in which the electrophotographic photosensitive member as recited in claim 1, and at least one of a charging means, a development means, and a cleaning means are combined together into one unit.

* * * * *

UNITED STATES PATENT AND TRADEMARK OFFICE

CERTIFICATE OF CORRECTION

PATENT NO. : 5,905,008

DATED : May 18, 1999

INVENTOR(S): KAZUO YOSHINAGA, ET AL.

It is certified that error appears in the above-identified patent and that said Letters Patent is hereby corrected as shown below:

ON THE TITLE PAGE AT [75]

Inventors: "Hiraoka, Shizuoka-ken;" should read --Hiraoka, Sunto-gun;--.

AT [57] ABSTRACT

Line 8, "$\{R_1'_{n1}SiO_{(4-n1)/2})\}_{y1}\{R_2'_{n2}SiO_{(4-n2)/2}\}_{y2}$. ." should read --$\{R_1'_{n1}SiO_{(4-n1)/2}\}_{y1}\{R_2'_{n2}SiO_{(4-n2)/2}\}_{y2}$ . . - - .

COLUMN 1

Line 50, "includes" should read --include--.

COLUMN 2

Line 25, "$\{R_1'_{n1}SiO_{(4-n1)/2})\}_{y1}\{R_2'_{n2}SiO_{4-n2)/2}\}_{y2}$. . ." should read --$\{R_1'_{n1}SiO_{(4-n1)/2}\}_{y1}\{R_2'_{n2}SiO_{(4-n2)/2}\}_{y2}$. . . - - ;

Line 32, "respectfully" should read --respectively--; and

Line 62, "$\{R_1'_{n1}SiO_{(4-n1)/2})\}_{y1}\{R_2'_{n2}SiO_{4-n2)/2}\}_{y2}$. . ." should read --$\{R_1'_{n1}SiO_{(4-n1)/2}\}_{y1}\{R_2'_{n2}SiO_{(4-n2)/2}\}_{y2}$. . . - - .

UNITED STATES PATENT AND TRADEMARK OFFICE

CERTIFICATE OF CORRECTION

PATENT NO. : 5,905,008

DATED : May 18, 1999

INVENTOR(S): KAZUO YOSHINAGA, ET AL.

It is certified that error appears in the above-identified patent and that said Letters Patent is hereby corrected as shown below:

COLUMN 3

Line 28, "symbols;" should read --symbols--;
Line 59, "$\{SiO_{4/2}\}_{0.1}$" should read --$\{SiO_{4/2}\}_{1.0}$--; and
Line 64, "$\{SiO_{4/2}\}_{1.0}$" should read --$\{SiO_{4/2}\}_{1.0}$--.

COLUMN 4

Line 22, "producting" should read -- producing--; and
Line 55, "has" should read --have--.

COLUMN 6

Line 21, "is" should read --are--.

COLUMN 8

Line 64, "potion" should read --portion--.

COLUMN 9

Line 5, "an" should read --a--; and
Line 13, "moves" should read --move--.

UNITED STATES PATENT AND TRADEMARK OFFICE

CERTIFICATE OF CORRECTION

PATENT NO. : 5,905,008

DATED : May 18, 1999

INVENTOR(S): KAZUO YOSHINAGA, ET AL.

It is certified that error appears in the above-identified patent and that said Letters Patent is hereby corrected as shown below:

COLUMN 10

Line 31, "$\{(C_6H_5)_2SiO_{2/2}\}_{y1}$" should read --$\{(C_6H_5)_2SiO_{2/2}\}_y$--.

COLUMN 12

Line 54, "75% of" should read --75% or--.

COLUMN 16

Line 40, "part" should read --parts--.

COLUMN 17

Line 3, "in sufficient" should read --insufficient--; and
Line 29, "Asolution" should read --A solution--.

COLUMN 19

Line 25, "obtaining" should read --obtain--.

COLUMN 20

Line 8, "obtaining" should read --obtain--.

UNITED STATES PATENT AND TRADEMARK OFFICE

CERTIFICATE OF CORRECTION

PATENT NO. : 5,905,008

DATED : May 18, 1999

INVENTOR(S): KAZUO YOSHINAGA, ET AL.

It is certified that error appears in the above-identified patent and that said Letters Patent is hereby corrected as shown below:

COLUMN 21

Line 36, "$R_1'_{n1}SiO_{(4-n1)/2})\}_{y1}\{R_2'_{n2}SiO_{4-n2)/2}\}_{y2}\ldots$"
should read --$\{R_1'_{n1}SiO_{(4-n1)/2}\}_{y1}\{R_2'_{n2}SiO_{4-n2)/2}\}_{y2}\ldots$--.

COLUMN 22

Line 19, "$R_p$ $R_1'$ $R_q'$" should read --$R_p$ and $R_1'$ to $R_q'$--.

Signed and Sealed this
Twenty-fifth Day of January, 2000

*Attest:*

*Attesting Officer*

*Acting Commissioner of Patents and Trademarks*